US009101810B2

(12) United States Patent
Carlson et al.

(10) Patent No.: US 9,101,810 B2
(45) Date of Patent: Aug. 11, 2015

(54) BAT HAVING VARIABLE PROPERTIES RELATIVE TO A SWING AXIS

(75) Inventors: Lawrence E. Carlson, Santa Clarita, CA (US); Max Kay, Seattle, WA (US); Dominnik Liang, Bellevue, WA (US); Michael J. Schindler, Seattle, WA (US)

(73) Assignee: Baden Sports, Inc., Federal Way, WA (US)

( * ) Notice: Subject to any disclaimer, the term of this patent is extended or adjusted under 35 U.S.C. 154(b) by 334 days.

(21) Appl. No.: 12/955,774

(22) Filed: Nov. 29, 2010

(65) Prior Publication Data

US 2012/0135826 A1 May 31, 2012

(51) Int. Cl.

| | |
|---|---|
| ***A63B 59/06*** | (2006.01) |
| *A63B 59/00* | (2015.01) |
| *A63B 71/06* | (2006.01) |

(52) U.S. Cl.

CPC ..... *A63B 59/06* (2013.01); *A63B 59/0074* (2013.01); *A63B 59/0092* (2013.01); *A63B 59/0033* (2013.01); *A63B 59/0051* (2013.01); *A63B 59/0055* (2013.01); *A63B 59/0088* (2013.01); *A63B 2059/0081* (2013.01); *A63B 2071/0694* (2013.01); *A63B 2209/10* (2013.01); *Y10T 29/49826* (2015.01)

(58) Field of Classification Search

CPC .... A63B 59/06; A63B 59/08; A63B 59/0078; A63B 59/0092; A63B 59/0014; A63B 59/0088; A63B 2059/0081; A63B 2069/0008; A63B 69/0002

USPC ..... 473/457, 519, 520, 564–568

See application file for complete search history.

(56) References Cited

U.S. PATENT DOCUMENTS

| | | | | |
|---|---|---|---|---|
| 5,088,733 | A * | 2/1992 | Barnea et al. | 473/568 |
| 5,114,144 | A | 5/1992 | Baum | |
| 5,131,651 | A * | 7/1992 | You | 473/520 |
| 5,593,158 | A | 1/1997 | Filice et al. | |
| 6,022,282 | A * | 2/2000 | Kennedy et al. | 473/567 |
| 6,048,283 | A * | 4/2000 | Albarelli, Jr. | 473/567 |
| 6,149,539 | A | 11/2000 | DeMarini | |
| 6,383,100 | B2 | 5/2002 | Pitsenberger et al. | |
| 6,461,260 | B1 | 10/2002 | Higginbotham | |
| 6,485,382 | B1 * | 11/2002 | Chen | 473/566 |
| 6,702,698 | B2 | 3/2004 | Eggiman et al. | |
| 6,729,983 | B1 | 5/2004 | Vakili et al. | |
| 6,733,404 | B2 | 5/2004 | Fritzke et al. | |
| 6,743,127 | B2 | 6/2004 | Eggiman et al. | |
| 6,761,653 | B1 | 7/2004 | Higginbotham et al. | |
| 6,945,886 | B2 | 9/2005 | Eggiman et al. | |
| 7,086,973 | B2 | 8/2006 | Wells et al. | |
| 7,097,578 | B2 | 8/2006 | Guenther et al. | |

(Continued)

*Primary Examiner* — Mark Graham

(74) *Attorney, Agent, or Firm* — Darren J. Jones; Lowe Graham Jones PLLC

(57) ABSTRACT

A bat having different stiffnesses in different planes relative to a longitudinal axis (i.e., swing axis) of the bat. More specifically, the bat includes a greater stiffness in a vertical plane as compared to relatively more flexible stiffness in a swing plane. This differential stiffness may be accomplished with an intermediate material located within an internal space defined where a handle affixes to a barrel of the bat or alternatively with a transitional member structurally arranged between the handle and the barrel of the bat. The transitional member may provide for vibration and/or shock dampening to minimize or eliminate the "sting" typically associated with monolithic, metallic bats. Additionally, the handle may include a shape that tends to naturally align the vertical and swing planes of the bat when the handle is gripped by a player.

6 Claims, 12 Drawing Sheets

(56) References Cited

U.S. PATENT DOCUMENTS

| | | | | |
|---|---|---|---|---|
| 7,140,988 | B1 | 11/2006 | Hinman | |
| 7,207,907 | B2 | 4/2007 | Guenther et al. | |
| 7,214,152 | B1 | 5/2007 | Vacek et al. | |
| 7,294,073 | B1 | 11/2007 | Vacek et al. | |
| 7,311,620 | B1 | 12/2007 | Heald et al. | |
| 7,377,866 | B2 * | 5/2008 | Van Nguyen | 473/566 |
| 7,377,868 | B2 | 5/2008 | Vacek et al. | |
| 7,381,141 | B2 * | 6/2008 | Van Nguyen | 473/566 |
| 7,410,433 | B2 | 8/2008 | Guenther et al. | |
| 7,419,446 | B2 * | 9/2008 | Nguyen | 473/567 |
| 7,442,134 | B2 | 10/2008 | Giannetti et al. | |
| 7,442,135 | B2 | 10/2008 | Giannetti et al. | |
| 7,572,197 | B2 | 8/2009 | Chauvin et al. | |
| 7,572,198 | B2 * | 8/2009 | Bleecker | 473/568 |
| 7,601,083 | B1 | 10/2009 | Heald et al. | |
| 7,611,428 | B2 | 11/2009 | Mathew et al. | |
| 7,651,420 | B1 | 1/2010 | Gaff et al. | |
| 2002/0082126 | A1 * | 6/2002 | Brundage | 473/457 |
| 2003/0144071 | A1 * | 7/2003 | Dodge et al. | 473/316 |
| 2004/0152545 | A1 | 8/2004 | Fritzke | |
| 2004/0157689 | A1 | 8/2004 | Fritzke et al. | |
| 2006/0122013 | A1 * | 6/2006 | Dodge et al. | 473/516 |
| 2006/0276275 | A1 | 12/2006 | Guenther et al. | |
| 2007/0249438 | A1 | 10/2007 | Vacek et al. | |
| 2008/0064538 | A1 | 3/2008 | McNamee et al. | |
| 2008/0070725 | A1 * | 3/2008 | Davis | 473/564 |
| 2008/0214338 | A1 | 9/2008 | Vacek et al. | |
| 2008/0220914 | A1 | 9/2008 | Shaw et al. | |
| 2009/0149285 | A1 * | 6/2009 | Miller | 473/564 |
| 2009/0215560 | A1 | 8/2009 | McNamee et al. | |
| 2009/0221388 | A1 * | 9/2009 | Giannetti et al. | 473/457 |
| 2009/0253540 | A1 | 10/2009 | Vacek et al. | |
| 2009/0264230 | A1 * | 10/2009 | Thouin | 473/567 |
| 2010/0009787 | A1 | 1/2010 | Vacek et al. | |
| 2010/0022334 | A1 * | 1/2010 | Gaff et al. | 473/567 |
| 2011/0086734 | A1 * | 4/2011 | Chung | 473/567 |
| 2012/0184402 | A1 * | 7/2012 | McNamee et al. | 473/520 |

* cited by examiner

BAT HAVING VARIABLE PROPERTIES RELATIVE TO A SWING AXIS

FIELD OF THE INVENTION

This invention relates generally to a bat having variable properties relative to a swinging axis, and more specifically a bat having a desired stiffness in a vertical plane while simultaneously having a desired flexibility and a desired amount of vibrational dampening in a swinging plane.

BACKGROUND OF THE INVENTION

Conventional bats typically have an axisymmetric stiffness about a swinging axis (i.e., longitudinal axis) and are monolithic structures made from a single material, such as aluminum or wood. The stiffness is defined in a three point bending test with the handle and barrel supported in a fixture and a load applied to a location somewhere in between. By measuring force and deflection, stiffness is calculated. Some bats may be configured as two-piece bats having one stiffness associated with the handle and a different stiffness associated with the barrel, respectively. The term "bat" is used in its broadest sense herein in that a bat may refer to a baseball bat, a softball bat, or any other type of bat that is used for any type of bat-n-ball game.

Some players prefer a lower bat stiffness to produce a faster bat speed with a more pronounced "whip effect." A lower stiffness bat may also have greater shock dampening to reduce the amount of vibration or "sting" as mainly felt by the player's hands during a collision between the but and the ball. Other players prefer a higher bat stiffness because it may allow the player to have better spatial control, which may correspond to the player being better able to adjust the bat in a vertical plane when swinging. Generally, a vertical position of a pitched ball varies or changes as it approaches the plate, so the player must make quick, often split second, vertical adjustments with the bat to prevent a strike or foul ball.

Most bats intended for amateur play are made from aluminum composites, or both and have a uniform axisymmetric stiffness. Wood bats, on the other hand, have a natural grain which generally provides a different stiffness in different planes normal to the bat's swinging axis. For instance, bats made from Ash wood are typically stronger when hit on an edge grain, so a bat manufacturer will usually place the label at a right angle relative to the edge grain, which in turn indicates to the player to hold the bat with the label facing skyward or up.

Some examples of conventional bats are briefly discussed herein, U.S. Pat. No. 7,086,973 to Wells et al. describes a bat having a non-circular handle with beveled, planar surfaces for accomplishing a favorable hand alignment and feel. The beveled surfaces provide a tactile guide that indicates a certain alignment the player can feel without visually verifying his or her hand position. Further, the '973 patent describes a baseball bat composed entirely of wood, but can also be composed at least in part of a suitable metal or even a composite material so long as the handle does not involve a resilient cushioning member, which isolates the finger tips of the batter from the planar regions of bat handle so that the sensory input provided is significantly diminished and therefore useless for any training purposes.

The following patents are assigned to Jas D. Easton, Inc. and Easton Sports, Inc., respectively, both from Van Nuys, Calif. U.S. Pat. No. 5,593,158 to Filice et al. describes a bat having a flexible connection between the handle and barrel to reduce shock transmitted to the player's hands in the event of an off-center hit. The respective stiffnesses of the handle portion and the barrel portion are uniform and axisymmetric. U.S. Pat. No. 7,572,197 to Chauvin et al. describes a bat having a flexible joint between the handle and barrel, where the may be a non-continuous or non-uniform structural joint. The bat includes some rotationally distinct features such as protruding flanges or radial strips that are arranged uniformly and axisymmetrically. U.S. Pat. No. 7,442,135 to Giannetti et al. describes a one-piece bat having an indented flexural focus region, which may be located in the handle, barrel or a transition section of the bat.

The following patents are assigned to Wilson Sporting Goods Company from Chicago, Ill. U.S. Pat. No. 6,702,698 to Eggiman et al. describes a bat having a stiff transition section with a flexible handle that provides some amount of whip action during the swing and shock attenuation during the hit. Again, the handle, transition section and barrel each have uniform, axisymmetric stiffnesses, respectively. U.S. Pat. No. 7,097,578 to Guenther et al. describes a bat without rotational stiffness differences that employs a round handle making the bat swingable in any orientation.

SUMMARY OF THE INVENTION

A bat includes different stiffnesses in different planes relative to a longitudinal axis (i.e., swinging axis) of the bat. By way of example, the bat includes a greater stiffness in approximately a vertical plane as compared to relatively more flexible stiffness in approximately a swing plane. This differential stiffness may be accomplished with a transitional member located between a handle and a barrel of the bat. The transitional member may further provide for vibration and/or shock dampening to minimize or eliminate the "sting" typically associated with monolithic, metallic bats. Additionally, the handle may include a shape that tends to naturally align the vertical and swing planes of the bat when the handle is gripped by a player.

In one aspect of the invention, abut having a longitudinal axis includes a handle; a barrel having an outer perimeter barrel surface concentrically aligned with the longitudinal axis; and a transitional member configured to structurally fix the barrel to the handle, the transitional member having an outer perimeter transitional surface concentrically aligned with the longitudinal axis, the transitional member having a vertical plane stiffness that is stiffer than a swing plane stiffness, wherein the vertical and swing planes are substantially normal to each other and intersect at the longitudinal axis.

In another aspect of the invention, a method of assembling a bat includes the steps of (1) arranging a handle, a transitional member and a barrel of the bat along a longitudinal axis, wherein at least the transitional member and bat are concentrically aligned with the longitudinal axis; (2) affixing the handle to the transitional member and the barrel to the transitional member; and (3) configuring the transitional member to have a vertical plane stiffness that is stiffer than a swing plane stiffness, wherein the vertical and swing planes are substantially normal to each other and intersect at the longitudinal axis.

In yet another aspect of the invention, a bat having a longitudinal axis includes a handle portion having a substantially cylindrical inner perimeter and a non-cylindrical outer perimeter; a barrel portion affixed to the handle portion, the barrel having substantially cylindrical inner and outer perimeters both concentric with the inner perimeter of the handle, the inner perimeter of the barrel portion spaced apart by a variable space from the outer perimeter of the handle portion, the variable space extending over a circumferential range approximately aligned with a swing plane of the bat; and an intermediate material located within the space, the intermediate material having a stiffness that is lower than at least a material of the barrel.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention generally relates, but is not limited, to a bat having different stiffnesses in different planes relative to a longitudinal axis (i.e., swinging axis) of the bat. More specifically, the bat includes a greater stiffness in a vertical plane as compared to relatively more flexible stiffness in a swing plane. This differential stiffness may be accomplished with a transitional member located between a handle and a barrel of the bat. The transitional member may provide for vibration and/or shock dampening to minimize or eliminate the "sting" typically associated with monolithic, metallic bats. The transitional member may also provide for increased bat "whip" generally along the swing plane while maintaining control by resisting unwanted movement generally along the vertical plane. The increased flexibility in the swing plane provides improved performance, while the relative stiffness in the vertical plane provides improved control. Additionally, the handle may include a shape that tends to naturally align the vertical and swing planes of the bat into preferred orientations when the handle is gripped by a player.

In one embodiment, the bat includes a higher stiffness in the vertical plane while being more compliant in the swing plane. These different stiffnesses may be incorporated into a transitional member located between the handle and barrel. In junction with the transitional member, the bat may include a contoured handle having a non-circular shape that may be comfortably gripped by the player while naturally urging the bat into a proper swinging orientation relative to the different stiffnesses. In one embodiment, the handle may include a downwardly forward curve in a region that would be covered by the player's hands when swinging the bat. This curvature may function as a naturally orienting feature for aligning the vertical and swing planes of the bat as well as providing a comfortable wrist alignment for the player during a swing and subsequent ball contact.

Figure 1A:
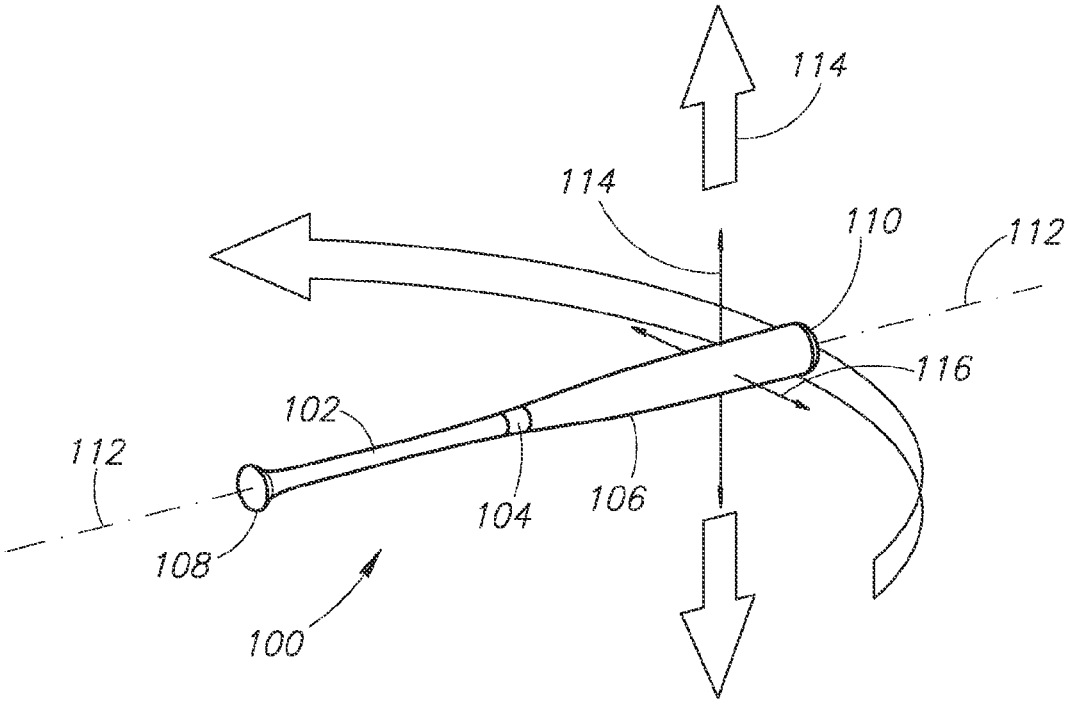
FIG. 1A is a perspective view of a bat having a handle, a transitional member and a barrel according to an embodiment of the present invention.

FIG. 1A shows a bat 100 having a handle 102, a transitional member 104 and a barrel 106. The bat 100 generally includes a knob or tip 108 coupled to the handle 102 and a cap, plug or other enclosure 110 coupled to the barrel 106. In most instances, the knob 108 is integrally formed with the handle 102 and the cap 110 is integrally formed with or fixed to the barrel 106. The interior of the bat 100 is preferably hollow, which permits the user to adequately accelerate and decelerate the bat and also to generate substantial bat speed during a swing.

The bat 100 has an overall length of 20 to 40 inches, or more preferably 26 to 34 inches. The overall barrel diameter is preferably 2.0 to 3.0 inches, and for baseball bats preferably in a range of 2.25 to 2.75 inches. For example, a typical baseball bats have diameters of 2.25, 2.625, or 2.75 inches. The bats 100 described herein may have various combinations of these dimensions, as well as any other suitable dimensions based on an application of the bat. Bat sizing is generally dictated by the player and may vary greatly depending on the player's size, swing characteristics, etc.

Figure 1B:
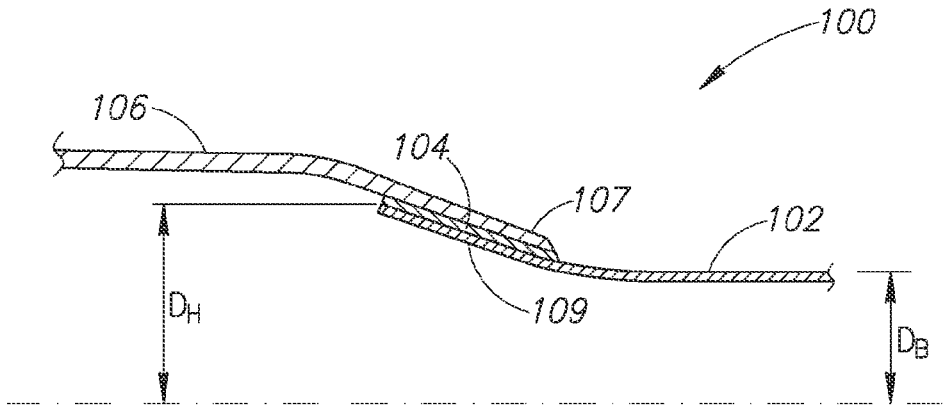
FIG. 1B is a longitudinal, cross-sectional view of a bat according to an embodiment of the present invention

The transitional member 104 is generally tapered to form a seamless structural transition with the handle 102 and the barrel 106. The transitional member 104 may be a single-wall or a multi-wall structure. By way of example and briefly referring to FIG. 1B, the transitional member 104 may be nested between respective overlapping barrel and handle portions 107, 109, respectively, as contrasted with being butt-joined to the barrel 106 and handle 102. Accordingly, the barrel portion 107 tapers to a diameter, $D_B$, that is smaller than a corresponding, flared end diameter, $D_H$, of the handle portion 109. During assembly, the handle 102, without the knob, is slid through the barrel 106 establish an interference fit between the overlapping portions 107, 109 and transitional member 104, respectively. Alternatively stated, the transitional member 104 may be configured to contact both the handle 102 and the barrel 106 and may also be configured to bond them together. The cap 110 and knob 108 may then be placed on the barrel 106 and handle 102, respectively.

In a preferred embodiment, the bat 100 defines a longitudinal axis 112 that coincides with at least an axisymmetric rotational axis defined by a body of the barrel 106. While the bat 100 may be moved freely in three-dimensional space, it is appreciated that there are two primary planes for controlling the bat during a swing, and these planes are a vertical plane 114 and a swing plane 116, both of which are described in more detail below and with reference to the following described figure.

Figure 2:
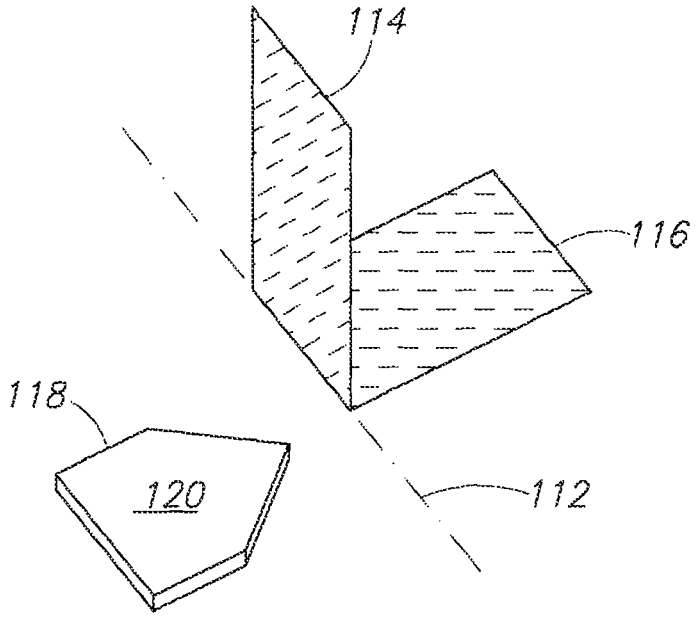
FIG. 2 is a schematic perspective view of a vertical plane and a swing plane relative to a longitudinal axis of a bat and relative to a home plate according to an embodiment of the present invention.

FIG. 2 shows the longitudinal axis 112 relative to a home plate 118. In one embodiment, the vertical plane 114 and swing plane 116 are substantially orthogonal to one another and intersect at the longitudinal axis 112. However, orthogonality is not required, and thus the planes 114, 116 may be skewed in space. For the purposes of the description herein, the planes 114, 116 are illustrated to generally indicate a frame of reference for the bat 100 during a swinging motion by the player (not shown) and therefore the terms "vertical" means approximately vertical while the term "swing" means approximately horizontal in relationship to the ground or upper surface 120 of the home plate 118.

Figure 3:
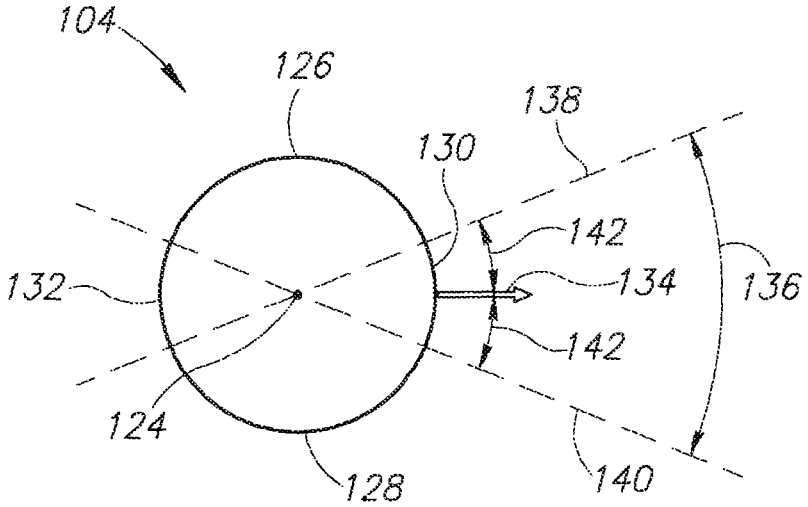
FIG. 3 is a cross-sectional view of the transitional member of FIG. 1 showing alignment planes for bounding stiffened and flexible portions of the transitional member according to an embodiment of the present invention.

FIG. 3 shows an alignment view of the bat 100 as looking down the transitional member 104. A center point 124 of the transitional member 104 indicates the longitudinal axis 112. The transitional member 104 includes upper and lower stiffened regions 126, 128, respectively, and side-to-side flexible regions 130, 132, respectively. An arrow 134 indicates a direction of swing for the bat 100 (FIG. 1) when held by a left-handed batter. Thus, the arrow 134 would lie substantially within the swing plane 116 (FIG. 2). The flexible regions 130, 132 may extend circumferentially relative to the arrow 134 by an arcuate range 136 and approximately bounded by first and second alignment planes 138, 140, respectively. The alignment planes 138, 140 may be offset from the swing plane 112 (arrow 134) by greater or less than (e.g., ±10 degrees) angle 142. Likewise, the stiffened regions 126, 128 are positioned opposite one another and generally extend between first and second alignment planes 138, 140.

Figure 4:
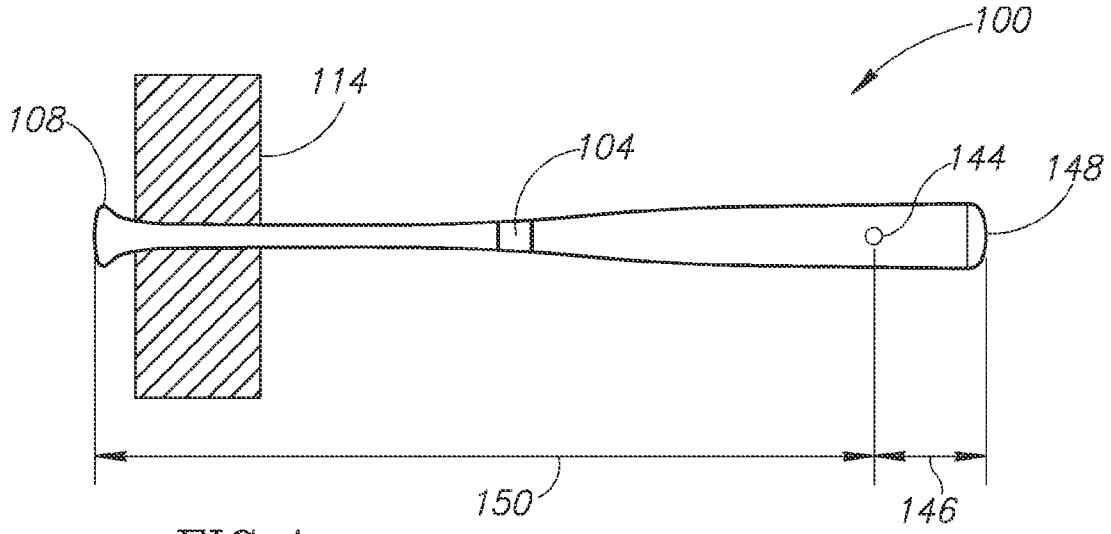
FIG. 4 is a side elevational view of the bat of FIG. 1 showing a location of a sweet spot for hitting a hall according to an embodiment of the present invention.

FIG. 4 shows the bat 100 having a sweet spot center 144 located a distance 146 from an end 148 of the bat 100 or alternatively from a distance 150 from the knob 108 of the bat. Generally, a swing stiffness, $K_S$, of the bat 100 in the swing plane 116 (FIG. 1) may be defined by a force, F, divided by a deflection of the bat 100 where the deflection is measured at a right angle to the bat's longitudinal axis 112 (FIG. 2). By way of example, the stiffness may be measured using a three-point bending test in which the bat is supported at each end and a load is applied somewhere therebetween. While there are various methods to support the bat, apply the load, and measure the deflection, one method that may be useful for isolating the stiffness is described in U.S. Pat. No. 6,945,886. Likewise, a vertical stiffness, $K_V$, of the bat 100 in the vertical plane 114 may be measured using a similar three-point bending method or test. In the illustrated embodiment and as described in more detail below, the transitional member 104 may be configured such that $K_S<K_V$. It is appreciated that the swing plane and vertical plane may not be exactly normal to one another as a result of different swing styles, thus the swing and vertical planes may exist over a range.

Figure 5A:
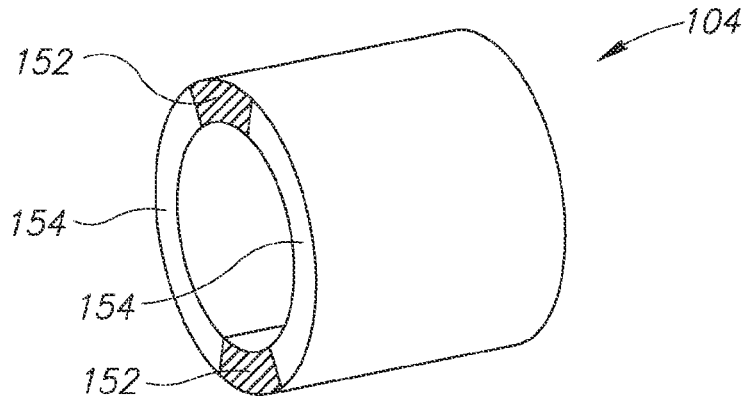
FIGS. 5A-5C are schematic, perspective views of various transitional members that have stiffened and flexible portions according to an embodiment of the present invention.
Figure 5B:
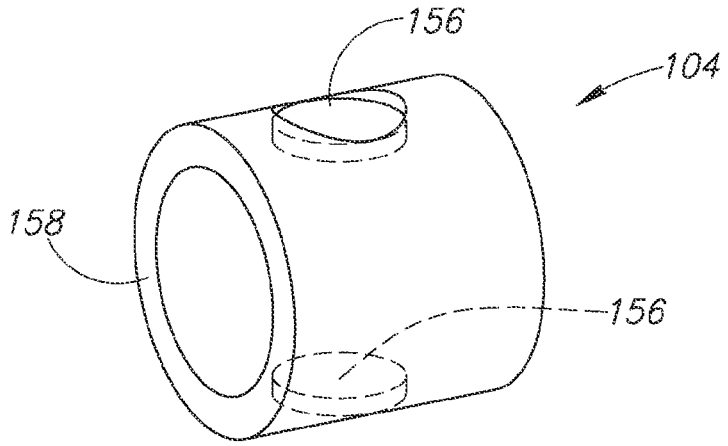
Figure 5C:
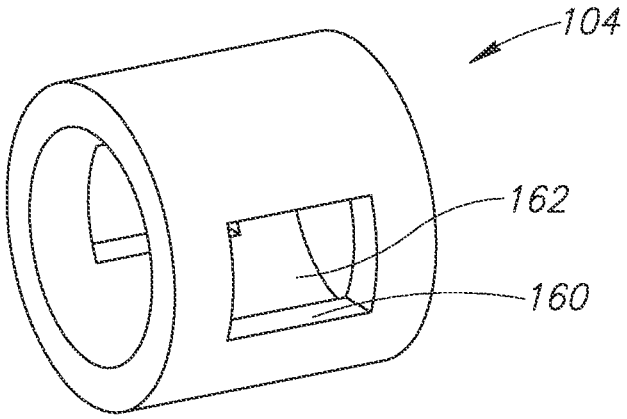

FIGS. 5A-5C show various configurations of the transitional member 104 that provide the bat 100 (FIG. 1) with a greater stiffness in approximately the vertical plane 114 (FIG. 1) as compared to a lesser stiffness (i.e., more flexible) in approximately the swing plane 116 (FIG. 1), FIG. 5C shows a cut edge of the transitional member 104 made from two different materials, a first, stiffer material 152 and a second, more flexible material 154. Referring back to FIG. 3, it is noted that the materials 152, 154 may be bounded by the alignment planes 138, 140 (FIG. 3).

FIG. 5B shows the transitional member 104 having inserts 156 that may be embedded into or received into pockets formed in a wall 158 of the transitional member 104. In one embodiment, the inserts 156 may structurally cooperate with transitional member to increase a vertical stiffness of the bat 100 (FIG. 1). Alternatively, the inserts may be a more flexible material with the alignment shifted approximately 90 degrees from that shown in FIG. 5B to increase the flexibility in the swing plane with the insert placement.

FIG. 5C shows the transitional member 104 having recesses 160 in which an amount of removed material 162 decreases the local bending stiffness approximately in the swing plane 116 (FIG. 1). Because a structural load path of the bat 100 (FIG. 1) must go from the barrel 106 to the handle 102 and therefore through the transitional member 104, the decrease in the local bending stiffness of the transitional member 104 provides more flexibility in the swing plane 116.

Each of the embodiments described in FIGS. 5A-5C operate to make the bat 100 stiffer in the vertical plane 114 and correspondingly more flexible in the swing plane 116, which in turn may produce a beneficial "whip effect" when swinging. In the vertical plane, the increased stiffness of the transitional member 104 may permit the batter to maneuver the bat faster in terms of acceleration or deceleration upwards or downwards when adjusting to a pitch. Conversely, conventional bats having an axisymmetric stiffness may be more difficult to control and/or may generate some lag when accelerating or decelerating. For example, the conventional bat may not move as fast or slow down as fast as intended by the player, thus possibly resulting in a strike or foul ball. Further, the configuration of the transitional member 104 may provide some amount of vibrational dampening to minimize or eliminate the sting felt by the player during certain impacts with the ball. Alternatively stated, the transitional member 104 may be configured to minimize propagation of at least one vibrational mode from the barrel to the handle. The vibrational mode includes a particular modal shape and corresponding frequency that is humanly perceptible by a player swinging the bat.

Figure 6:
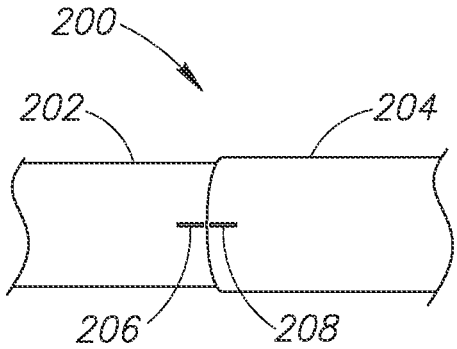
FIG. 6 is a partial perspective view of a bat showing a handle and a transitional member with alignment indicia according to an embodiment of the present invention.

FIG. 6 shows a portion of a bat 200 having a handle 202 and a transitional member 204. The handle 202 includes first alignment indicia 206, which may take the form of visible markings, non-visible protuberances/depressions or some other type of indicia. The transitional member 204 includes second alignment indicia 208, similar to the first alignment indicia 206 and correspondingly aligned therewith. The indicia 206, 208 may represent to the player that the stiffened portion of the transitional member 204 is at least approximately aligned with the vertical plane (FIG. 2) or conversely that the flexible portion is at least approximately aligned with the swing plane (FIG. 2). The alignment of the handle relative to the transitional member allows the user to "tune" the bat to the user's particular grip and swing characteristics. Thus, the sweet spot center 144 will more closely be aligned properly for the particular user.

Figure 7A:
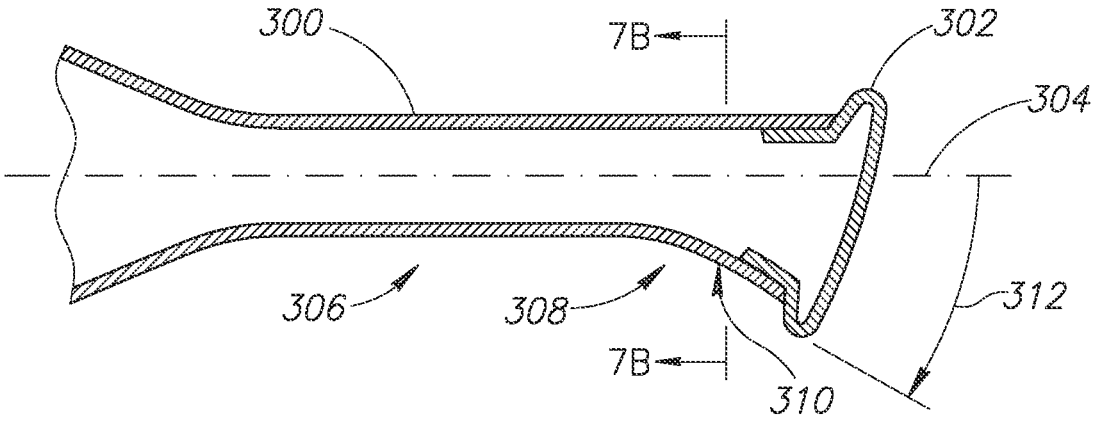
FIG. 7A is a partial, cross-sectional view of a bat handle in which at least a portion of the handle is non-concentric with respect to a longitudinal axis of the bat according to an embodiment of the present invention.
Figure 7B:
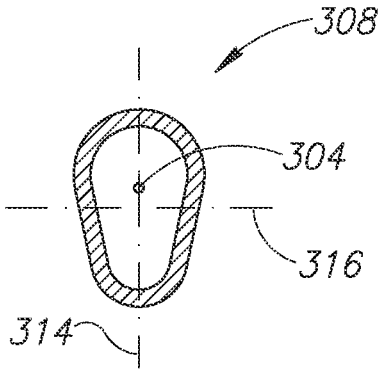
FIG. 7B is a cross-sectional view taken along line 7B-7B of FIG. 7A showing the portion of the handle having an oblong shape according to an embodiment of the present invention.

FIGS. 7A and 7B show a handle 300 and knob 302 of a bat in which at least a portion of the handle 300 is non-concentrically aligned with a longitudinal axis 304. In the illustrated embodiment, the handle 300 includes a cylindrical portion 306 and an oblong portion 308, which is best shown in the cross-sectional view of FIG. 7B. The oblong portion 308 may include a downward sloping curved surface 310 in the region of the handle 300 adjacent the knob 302. The curved surface 310 is non-parallel with respect to the longitudinal axis 304 as indicated by angle 312. By way of example, the oblong portion 308 may generally take the form of an ellipse having a major axis 314 and a minor axis 316. Alternatively, the handle may be partially formed by an extended knob that provides the oblong portion 308 and joins the remainder of the handle at a cylindrical region.

Figure 8:
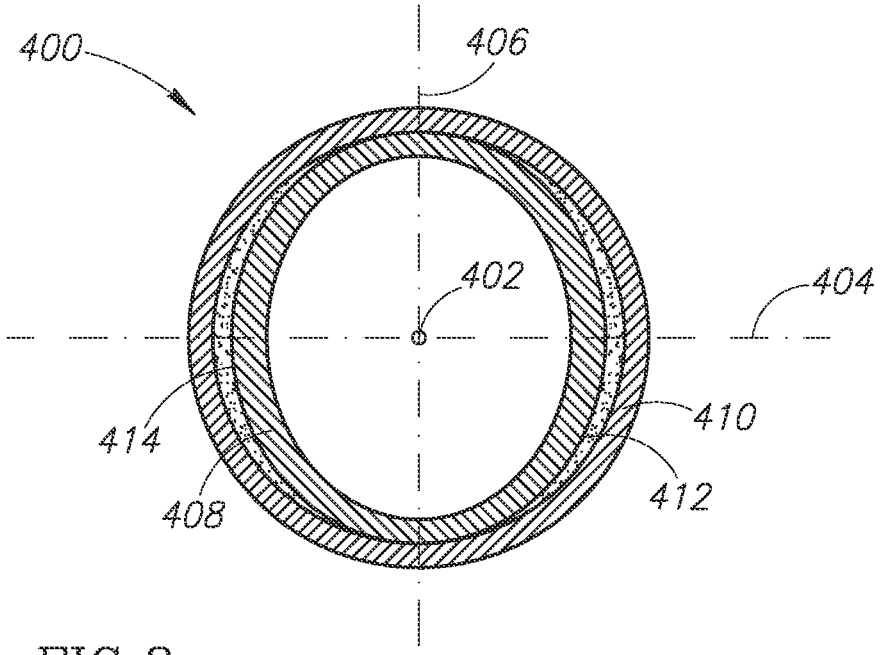
FIG. 8 is a cross-sectional view of a transitional member coupled to a handle and a barrel according to an embodiment of the present invention.

FIG. 8 shows a cross-section of a bat 400 having a longitudinal axis 402 that intersects a swing plane 404 and vertical plane 406. A handle 408 is shown coupled to a barrel 410 with an intermediate material 412, which may take the form of an adhesive or bonding agent, an elastomeric glue, or some other material arranged in a configuration to reduce a stiffness of the bat 400 in the swing plane relative to the vertical plane. In the illustrated embodiment, the barrel 410 includes a substantially circular cross-sectional shape while the handle 408, at least in the region of intersection with the barrel, includes a non-circular shape such as, but not limited to, an oval, oblong, elliptical or other shape. Alternatively the end of the barrel that extends over the handle may have a non-circular cross-sectional shape, while the handle remains circular in cross section. Further alternatives include both the barrel and the handle being non-circular in the region of intersection. A result of these different cross-sectional shapes provides a space 414 in which the intermediate material 412 may be inserted or provided. As discussed previously, the space 414 may be bounded by alignment planes as indicated in FIG. 3.

Figure 9A:
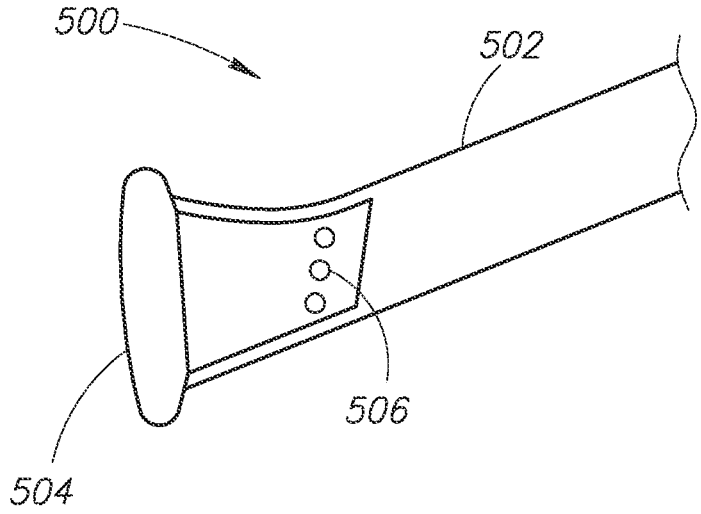
FIG. 9A is a partial side elevational view of a bat handle and knob having apertures for adjusting a swing characteristic of the bat according to an embodiment of the present invention.
Figure 9B:
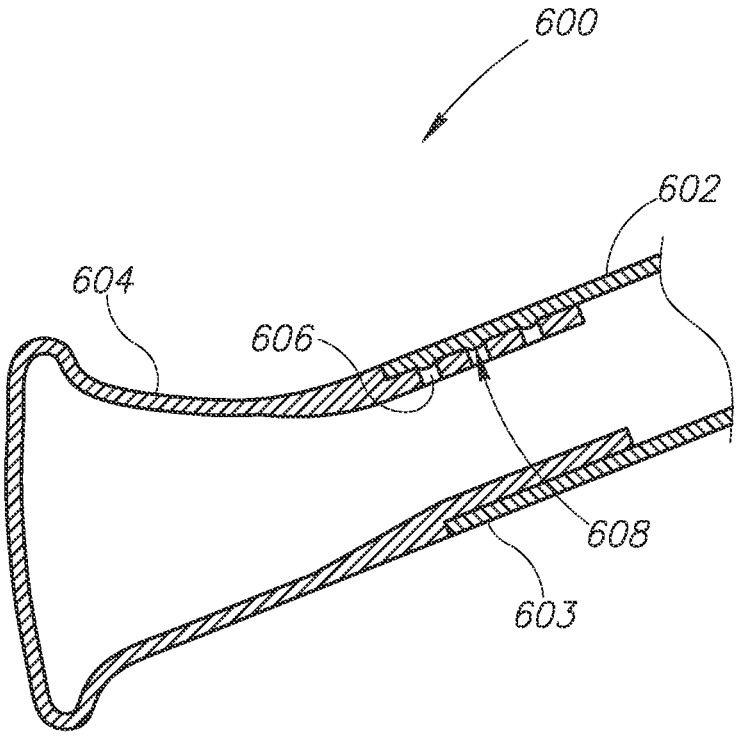
FIG. 9B is a partial cross-sectional view of a bat handle adjustable relative to a knob for adjusting a swing characteristic of the bat according to an embodiment of the present invention.

FIG. 9A shows a portion of a bat 500 with a handle 502 coupled to an extended knob 504. In the illustrated embodiment, an asymmetric configuration of the handle 502 is provided primarily by the handle 504, and the knob 504 extends into the handle. The handle 502 and the knob 504 include apertures 506, which may take the form of holes, slots, grooves, channels, etc. configured to permit an adjustment of a swing characteristic of the bat 500. The apertures 506 allow the knob 504 to be shifted slightly relative to the handle 502 to align the swing plane of the bat 500 for a particular batter. Because each batter may have variations in how they swing the bat 500, even with the asymmetrically configured handle, the apertures 506 provide an opportunity to tune-tune (e.g., selectively align) the knob 504 with respect to the handle 502 so the batter may take appropriate advantage of the vertical stiffness and swing-plane flexibility FIG. 9B shows a portion of a bat 600 with a handle 602 coupled to an extended knob 604. In the illustrated embodiment, an asymmetric configuration of the handle 602 is provided primarily by a shape of the extended knob 604, such that the knob 604 fits within a cylindrically shaped handle portion 603. In the illustrated embodiment, the knob 604 includes apertures 606, which may take the form of holes, slots, grooves, channels, etc. that engage protuberances or detents 608 of the handle 602. Accordingly, the knob 604 may be rotated relative to the handle 602 with the detents 608 engaging selected apertures 606 to permit an adjustment of a swing characteristic of the bat 500 via alignment as discussed above. Similar to the previous embodiment, the apertures 606 and protuberances 608 allow the knob 604 to be shifted slightly to align the bat 600 for a particular batter to take advantage of the vertical stiffness and swing plane flexibility.

Figure 10A:
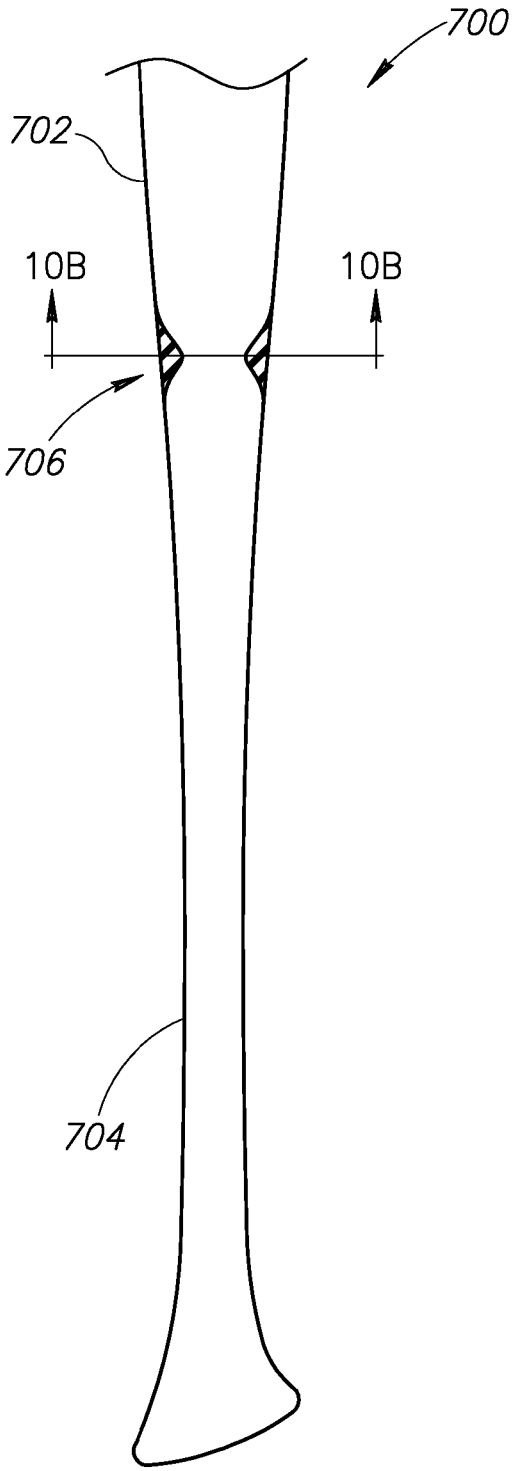
FIG. 10A is a side elevational view of a bat with a necked down section according to an embodiment of the present invention.
Figure 10B:
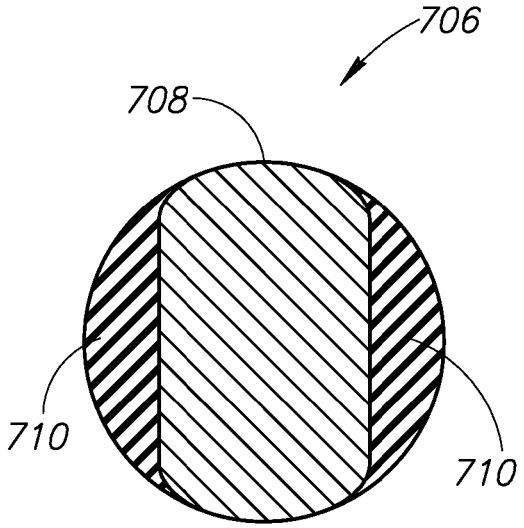
FIG. 10B is a cross-sectional view of the necked down section taken along line 10B-10B of FIG. 10A.

FIGS. 10A and 10B show a portion of a bat 700 having a variable stiffness achieved using a reduced section in conjunction with an elastomer. A barrel portion 702 is joined to a handle portion 704 through a flexible portion 706. As best shown in FIG. 10B, the flexible 706 includes a necked down region 708 positioned between an elastomeric material 710 as viewed from a desired plane. The necked down region 708 may be of the same material and continuously formed with the barrel portion 702 and handle portion 704. Alternatively stated, the bat 700 may be a one-piece bat with the flexible portion 706 located where a greater amount of flexure is desired. The elastomeric material 710 may operate as a filler to bring the cross-sectional profile of the bat 700 out to a desired contour, most likely circular.

Figure 11:
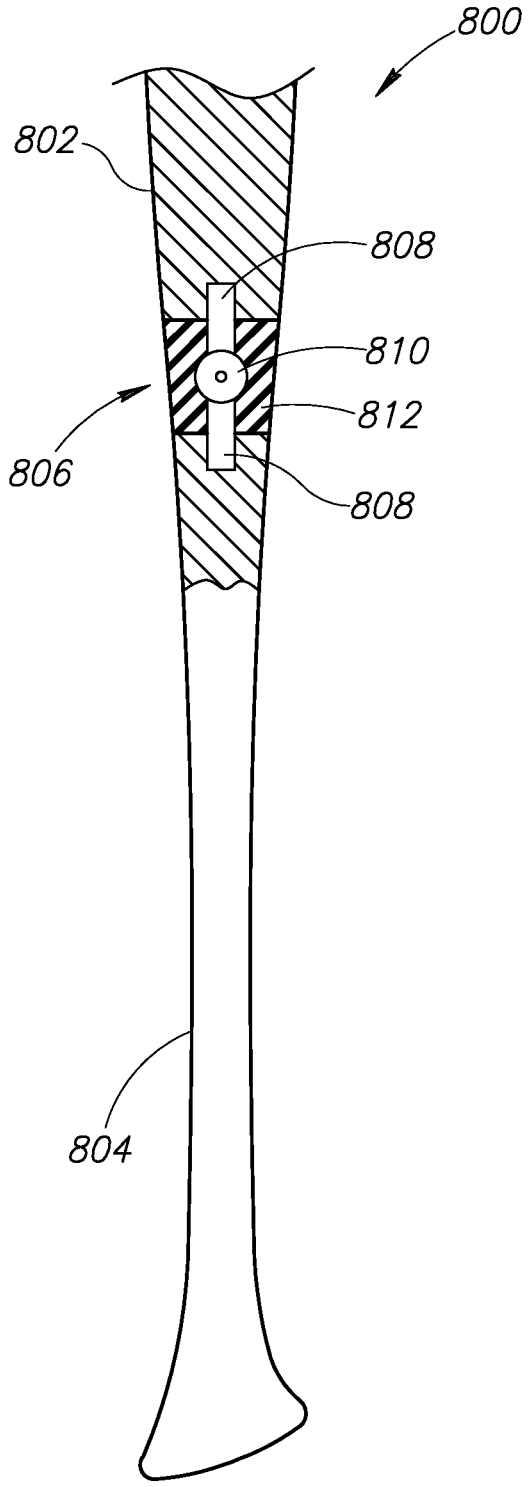
FIG. 11 is a cross-sectional view of a bat with a hinge device according to an embodiment of the present invention.

FIG. 11 shows a bat 800 having a barrel portion 802 coupled to a handle portion 804 through a hinge assembly 806. In the illustrated embodiment, the hinge assembly 806 includes longitudinal arms 808 extending from a dynamic hinge device 810. The arms 808 are secured into the barrel and handle portions 802, 804, respectively, through mechanical means such as pins or hot glue bonding. At least a portion of the hinge assembly 806 may be embedded into an elastomeric material 812.

Figure 12A:
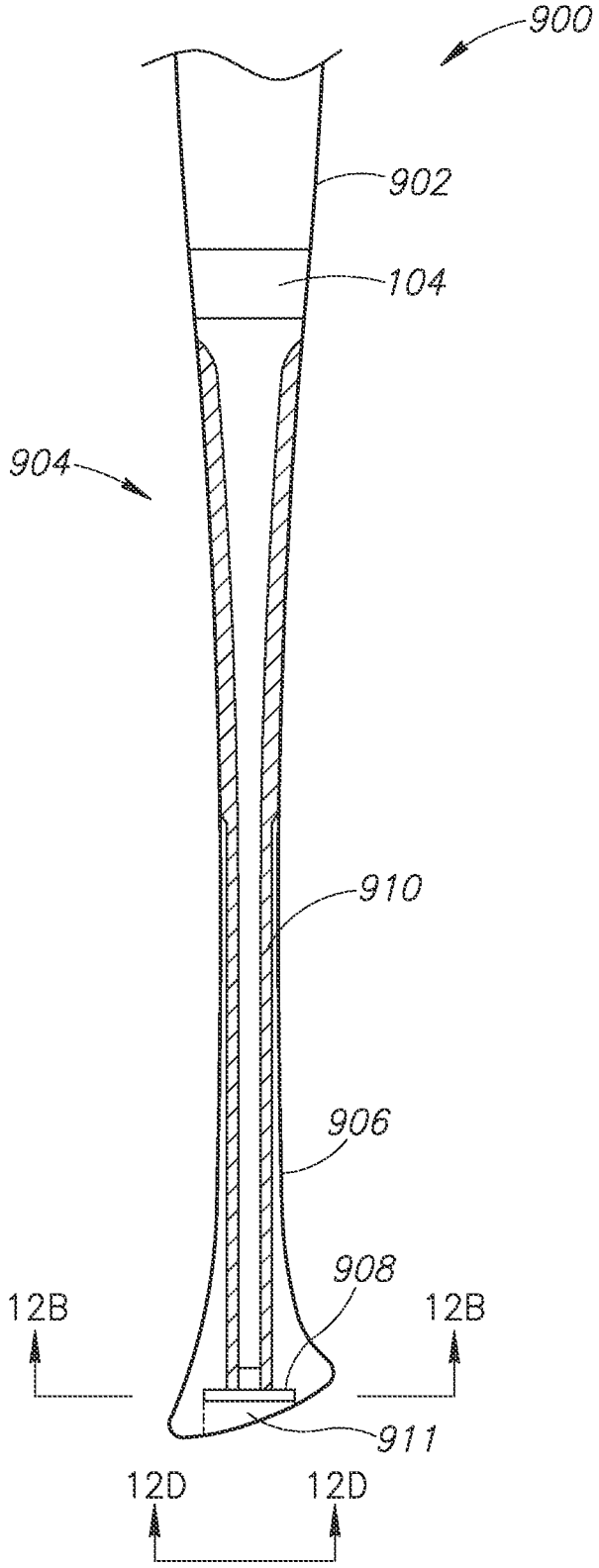
FIG. 12A is a cross-sectional view of a portion of a bat with an adjustable handle according to an embodiment of the present invention.
Figure 12B:
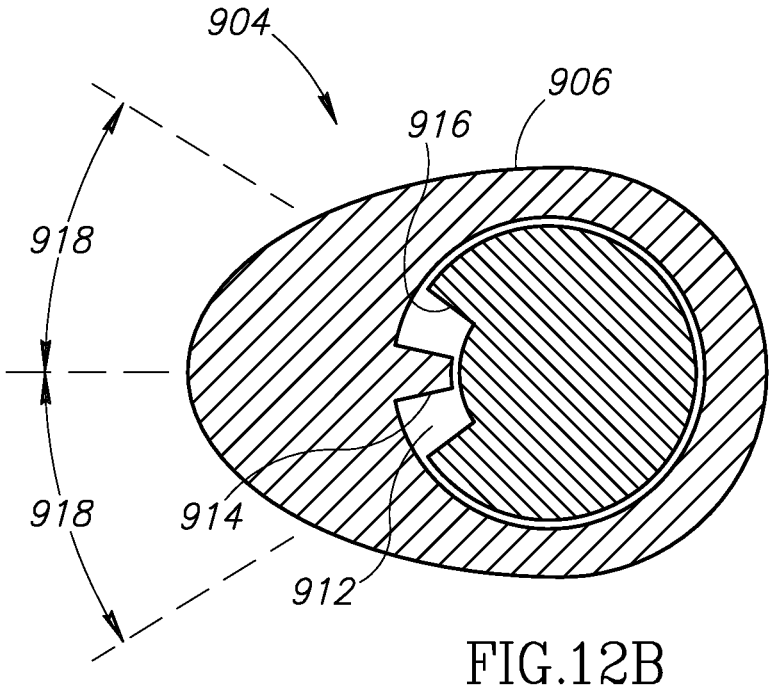
FIG. 12B is a cross-sectional view taken along line 12B-12B of FIG. 12A showing an engagement of an outer sleeve and a plug of the bat.

FIGS. 12A and 12B show another alternate embodiment of a bat 900 having a barrel portion 902 coupled to a handle portion 904. The transitional member 104 is also illustrated and may encompass any of the embodiments described herein. The handle portion 904 includes an outer sleeve 906 that is rotationally adjustable relative to the barrel portion 902 for alignment of the handle with the sweet spot based on the user's grip and swing characteristics. Outer handle sleeve 906 is secured to a reduced handle member 910, preferably using a thermoplastic material, such as a hot-melt glue layered as a film between the two. A retention plug 908 is fixed to the end of the transitional member to avoid the axial movement of the handle sleeve 906. This also increases the safety of the assembly such that the handle is safely secured during bat swing. The outer sleeve 906 is receivably slid onto the reduced member 910 with a layer of thermoplastic adhesive or bonding agent (e.g., hot glue) located between the sleeve 906 and member 910. The adhesive may provide some additional structural dampening for the bat 900. The plug 908 is fixed to the reduced member 910 to prevent sleeve 906 from axial translational movement relative to member 910. Thus, even when heated to melt the bonding agent, sleeve 906 can be rotated, but not accidentally removed from member 910. In some embodiments, the plug 908 may also operate to prevent over rotation of the outer sleeve 906 relative to the reduced member 910. An end cavity 911 adjacent the installed plug 908 may be filled with a material so the plug would not be viewable.

In the embodiment illustrated of FIG. 12B, the plug 908 includes a female engagement portion 912 (e.g., notched area) configured to receive a male engagement portion 914 (e.g., protruding tab) of the outer sleeve 906. The tab 914 is smaller than the notched area 912, which in turn permits the outer sleeve 906 to be rotated relative to both the plug 908 and the handle member 910, which are fixed together as previously mentioned. Respective sidewalls 916 of the female engagement portion 914 operate as rotational limiting stops. In one embodiment, the sidewalls 916 are arranged to limit rotation of the outer sleeve 906 by an angle 918. Preferably, the angle 918 is a range of about ±1 to ±30 degrees, but may also be configured to be outside of this range, if desired. For fine adjustments, the angle 918 may optionally be limited to a range of about ±5 to ±15 degrees.

Figure 12C:
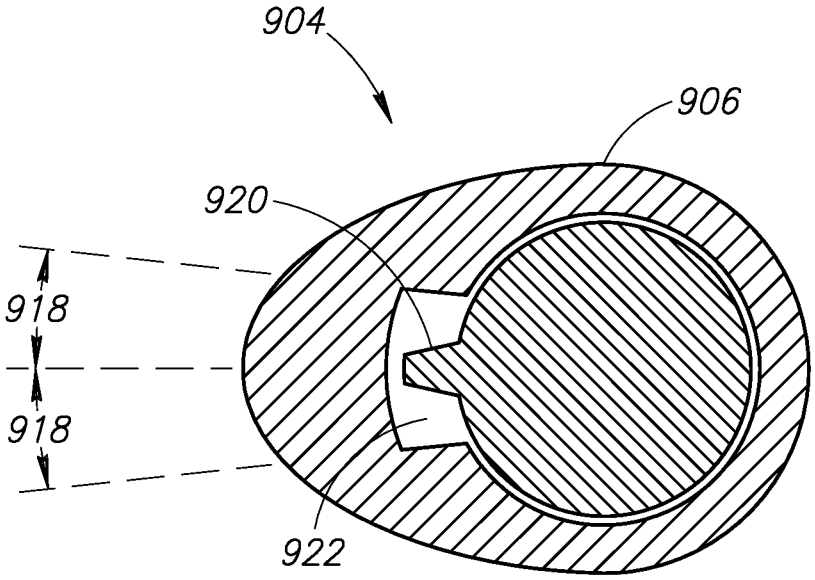
FIG. 12C is a cross-sectional view of an alternative engagement of the outer sleeve and the plug of the bat.

In an alternate embodiment, as illustrated in FIG. 12C, the plug 908 includes a male engagement portion 920 and the outer sleeve 906 includes the mating, female engagement portion 922. Accordingly, the outer sleeve 906 may be rotated with respect to the limits provided by angle 918.

Adjusting the outer sleeve 906 relative to the transitional member 104 and the barrel sweet spot may be accomplished by heating the adhesive or bonding agent located between the sleeve 906 and transitional member 910. In one embodiment, the heat may be provided with a conventional hair dryer in which the applied heat sufficiently softens (e.g., lowers its viscosity) the molecular adhesive bonds to allow torsional shearing of the adhesive to occur while the barrel 902 is held in place and the outer sleeve 906 is rotated in either a clockwise or a counterclockwise direction relative to the handle member 910, which is fixed to the barrel 902.

Figure 12D:
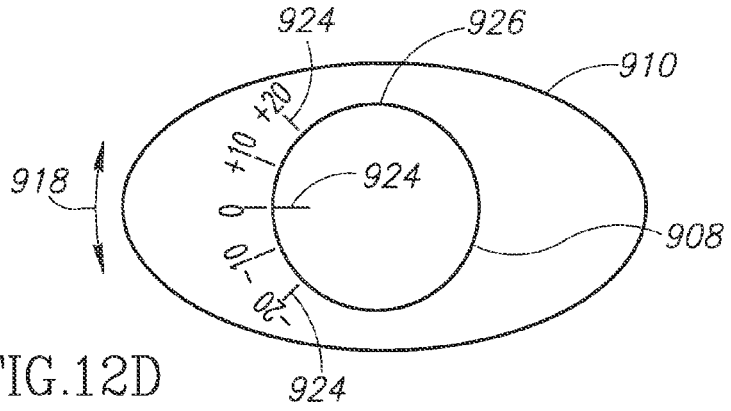
FIG. 12D is bottom, plan view of a bat having rotational indicators according to an embodiment of the present invention.

In one embodiment as best shown in FIG. 12D, visible indicators 924 may be placed on an end cap region 926 of the handle portion 904 that would provide at least an approximate indication as to how far the outer sleeve 906 had been rotated relative to the plug 908 and the transitional member 104. Once a batter determines how he or she prefers the handle portion 904 oriented relative to the barrel 902, the batter or someone else may adjust the handle portion 904 accordingly. Thus, the batter can rotationally adjust the handle portion 904 to optimize the barrel hitting surface in accordance with the batter's grip, handedness (i.e., left or right handed batter), and swing style. In yet another embodiment, the plug 908 may include opposing notches that would allow the outer sleeve 906 to be rotated by 180 degrees and a set screw may be inserted to help secure the outer sleeve 906, the plug 908 and the transitional member 104 relative to one another.

Figure 12F:
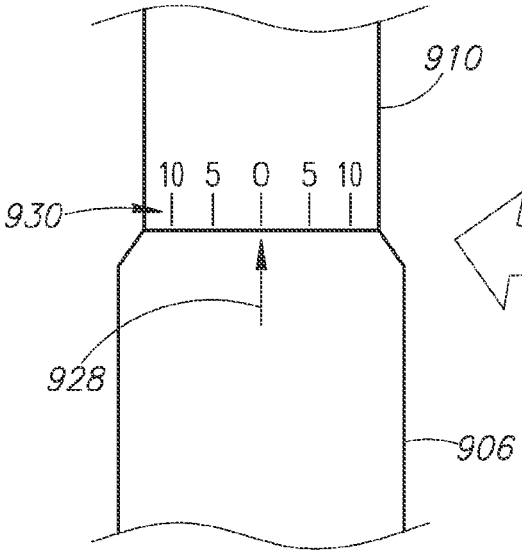
FIG. 12F is a side elevational view of the bat of FIG. 12E with rotational indicators according to an embodiment of the present invention.
Figure 12E:
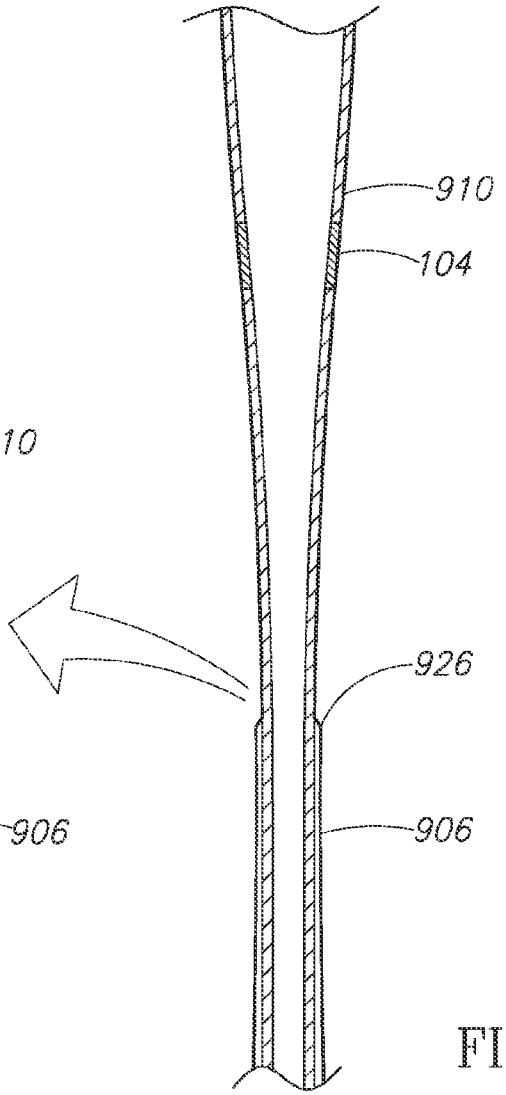
FIG. 12E is a cross-sectional view of a bat having an outer sleeve that is non-flush with a transitional member at an intersection region according to an embodiment of the present invention.

FIG. 12E shows an embodiment in which the outer sleeve 906 is non-flush with the member 910. The sleeve 906 includes tapered end portions 926 that provide a transitional shoulder between the sleeve 906 and the member 910.

FIG. 12F shows a first indicator 928 in the shape of an arrow located on the outer sleeve 906 and incremental indicators 930 providing a number of degrees the outer sleeve 906 has been rotated relative to the transitional member 910. It is appreciated that the indicators 928, 930 may take other shapes or designs or they may be reversed wherein the first indicator 928 is on the member 910 and the incremental indicators 930 are on the outer sleeve 906. As discussed above, the adjustment of the asymmetric handle alignment with the transitional member and the barrel will provide for tuning of the bat to the particular user to optimize the swing whip and bat control aspects of the invention provided by the differential stiffness of the bat in the vertical and swing planes.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The invention claimed is:

1. A ball bat for a ball player, the bat having a longitudinal axis, a swing plane, and a vertical plane transverse to the swing plane, the planes intersecting at the longitudinal axis, the bat comprising:

a handle including a grippable portion for holding by the player, at least a portion of the grippable portion having a non-cylindrical outer surface for alignment of the handle in the grip of the player for consistent bat swinging substantially in the swing plane;

a barrel having an outer perimeter barrel surface concentrically aligned with the longitudinal axis;

a transitional portion between the barrel and handle, the transitional portion including a portion with reduced stiffness in the swing plane relative to the stiffness of the transitional portion in the vertical plane, wherein the transition portion is comprised of the barrel concentrically overlapping the handle with a space between the barrel and handle, the space being at least partially filled with a material in the vertical plane that is stiffer than the material at least partially filling the space in the swing plane; and wherein an outer portion of the transitional portion includes a first recess generally along the swing plane.

2. A ball bat for a ball player, the bat having a longitudinal axis, a swing plane, and a vertical plane transverse to the swing plane, the planes intersecting at the longitudinal axis, the bat comprising:

a handle including a grippable portion for holding by the player, at least a portion of the grippable portion having a non-cylindrical outer surface for alignment of the handle in the grip of the player for consistent bat swinging substantially in the swing plane;

a barrel having an outer perimeter barrel surface concentrically aligned with the longitudinal axis;

a transitional portion between the barrel and handle, the transitional portion including a portion with reduced stiffness in the swing plane relative to the stiffness of the transitional portion in the vertical plane, the transitional portion having differing materials in the swing plane from the materials in the vertical plane, such materials having differing stiffnesses;

wherein the transitional portion is configured to structurally fix the barrel to the handle, the transitional portion having an outer perimeter transitional surface substantially aligned with the longitudinal axis, the transitional portion having a stiffness in a first plane that is different than a stiffness in a second plane orthogonal to the first plane, the first and second planes intersecting at the longitudinal axis, the transitional portion being positioned within the barrel and a portion of the handle being positioned within the transitional portion; and wherein the transitional portion defines first and second apertures positioned on opposite sides of the handle; wherein a first insert is positioned within the first aperture and extends completely across and completely fills the first aperture; and wherein a second insert is positioned within the second aperture and extends completely across, and completely fills the second aperture.

3. The bat of claim 2, wherein the transitional portion defines an outer surface contacting the barrel and an inner surface opposite the outer surface and contacting the handle, the first and second inserts being flush with both the inner and outer surfaces.

4. The bat of claim 3, wherein the transitional portion includes a distal edge and a proximal edge opposite the distal edge, the distal and proximal edges each extending between the outer surface and the inner surface, the barrel extending continuously over and covering an entire extent between the entire distal edge and the entire proximal edge, the outer surface being in contact with the barrel; the handle is positioned within the transitional portion having both the distal edge and the proximal edge encircling the handle, the inner surface contacting the handle; and wherein the two apertures are positioned between the proximal and distal edges of the transitional portion, the two apertures each extending through the transitional portion from the outer surface to the inner surface.

5. A ball bat for a ball player, the bat having a longitudinal axis, a swing plane, and a vertical plane transverse to the swing plane, the planes intersecting at the longitudinal axis, the bat comprising:

a handle including a grippable portion for holding by the player, at least a portion of the grippable portion having a non-cylindrical outer surface for alignment of the handle in the grip of the player for consistent bat swinging substantially in the swing plane;

a barrel having an outer perimeter barrel surface concentrically aligned with the longitudinal axis;

a transitional portion between the barrel and handle, the transitional portion including a portion with reduced stiffness in the swing plane relative to the stiffness of the transitional portion in the vertical plane, the transitional portion having differing materials in the swing plane from the materials in the vertical plane, such materials having differing stiffnesses;

wherein at least the grippable portion of the handle is rotatable relative to the barrel; and further comprising rotational measurement indicia carried on the bat between the rotatable grippable portion of the handle and a portion of the bat that does not rotate relative to the barrel, said measurement indicia indicating the rotated relationship between the barrel and the grippable portion.

6. The bat of claim 5, wherein the indicia are provided in angular degrees of rotation to show a rotation of the handle relative to the barrel.

* * * * *